US012767372B2

(12) United States Patent
Backaert et al.

(10) Patent No.: US 12,767,372 B2
(45) Date of Patent: Oct. 20, 2026

(54) STORAGE BAG WITH ELASTIC INTERLOCK CLOSURE

(71) Applicant: Party IP Holdings, LLC, Orlando, FL (US)

(72) Inventors: Dimitri M.C.J. Backaert, Moorsel (BE); Simon Millecam, Anderlecht (BE); Wim De Vos, Kruisem (BE)

(73) Assignee: Party IP Holdings, LLC, Orlando, FL (US)

( * ) Notice: Subject to any disclaimer, the term of this patent is extended or adjusted under 35 U.S.C. 154(b) by 0 days.

(21) Appl. No.: 18/105,861

(22) Filed: Feb. 5, 2023

(65) Prior Publication Data

US 2024/0262557 A1 Aug. 8, 2024

(51) Int. Cl.
*B65D 33/25* (2006.01)
*B65B 61/18* (2006.01)

(52) U.S. Cl.
CPC ..... *B65B 61/188* (2013.01); *B65D 2251/023* (2013.01); *B65D 2251/20* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 24/384, 389, 403, 432, 433; 383/61.1, 383/63–65, 97
See application file for complete search history.

(56) References Cited

U.S. PATENT DOCUMENTS 2,746,502 A * 5/1956 Alberto ..... B65D 33/2508 383/65
2,910,754 A * 11/1959 Morin ..... A44B 19/32 24/384
4,941,238 A * 7/1990 Clark ..... A44B 19/32 24/584.1
5,088,164 A 2/1992 Wilson et al.
5,212,855 A 5/1993 McGANTY
D473,426 S 4/2003 Jalet et al.
D573,390 S 7/2008 Ablo
(Continued)

FOREIGN PATENT DOCUMENTS

CN 1266006 A 9/2000
CN 102333704 A 1/2012
(Continued)

*Primary Examiner* — Nathan J Newhouse
*Assistant Examiner* — Nina K Attel
(74) *Attorney, Agent, or Firm* — COOLEY LLP

(57) ABSTRACT

A reusable elastomeric bag includes a monolithic interlock closure system including a pair of interlock strips each of which includes a plurality of teeth sized and spaced to be received in a plurality of mating gaps. The interlock integrity is improved by a series of blocking ledges extending outward to block an interior end of the gaps. This serves to prevent movement of the teeth within the interlock plane. Where the interlock strips are secured at one or both lateral ends, the interlock integrity is improved be each strip including a curved end segment terminating at a common end point. The tangent to the end segments at this end point will make an angle to the interlock plane.

16 Claims, 9 Drawing Sheets

(56) References Cited

U.S. PATENT DOCUMENTS

| | | | | |
|---|---|---|---|---|
| D574,191 | S | 8/2008 | Ablo | |
| 7,870,649 | B2 * | 1/2011 | Mikuma | A44B 19/04 24/405 |
| D873,083 | S | 1/2020 | Finell et al. | |
| D873,084 | S | 1/2020 | Finell et al. | |
| D876,172 | S | 2/2020 | Finell et al. | |
| D887,786 | S | 6/2020 | Finell et al. | |
| D919,443 | S | 5/2021 | Liao | |
| D927,297 | S | 8/2021 | Carpinelli | |
| 11,098,940 | B2 | 8/2021 | Finell | |
| D936,363 | S | 11/2021 | Castenson et al. | |
| D945,827 | S | 3/2022 | Finell et al. | |
| D953,813 | S | 6/2022 | Liao | |
| D965,438 | S | 10/2022 | Yang | |
| D971,403 | S | 11/2022 | Slotten | |
| D971,744 | S | 12/2022 | Yang | |
| D980,071 | S | 3/2023 | Yee | |
| D984,218 | S | 4/2023 | Yee et al. | |
| D987,442 | S | 5/2023 | Taboada | |
| D994,499 | S | 8/2023 | Carpinelli | |
| D994,500 | S | 8/2023 | Carpinelli | |
| D996,224 | S | 8/2023 | Carpinelli | |
| D1,004,383 | S | 11/2023 | Peng | |
| 11,827,420 | B2 | 11/2023 | Shin | |
| D1,007,327 | S | 12/2023 | Carpinelli | |
| D1,008,744 | S | 12/2023 | Chen | |
| D1,012,727 | S | 1/2024 | Carpinelli | |
| D1,034,226 | S | 7/2024 | Porchia et al. | |
| D1,034,227 | S | 7/2024 | Porchia et al. | |
| D1,034,228 | S | 7/2024 | Porchia et al. | |
| D1,034,237 | S | 7/2024 | Porchia et al. | |
| D1,053,017 | S | 12/2024 | Fossiez et al. | |
| 2006/0029697 | A1 | 2/2006 | Robbins et al. | |
| 2009/0110335 | A1 | 4/2009 | Leboeuf | |
| 2014/0270579 | A1 * | 9/2014 | Nouri | B65D 33/2541 383/98 |
| 2021/0214129 | A1 * | 7/2021 | Woo | B65D 33/01 |
| 2022/0306346 | A1 * | 9/2022 | Shin | B65D 33/065 |
| 2022/0324602 | A1 | 10/2022 | Avalos et al. | |
| 2023/0180898 | A1 * | 6/2023 | Kim | A44B 19/06 24/415 |

FOREIGN PATENT DOCUMENTS

| | | | |
|---|---|---|---|
| CO | 0020230009039-001 | | 7/2023 |
| EP | 0434447 | A1 | 6/1991 |
| FR | 2816597 | A1 | 5/2002 |
| WO | WO-2010096609 | A1 | 8/2010 |

* cited by examiner

STORAGE BAG WITH ELASTIC INTERLOCK CLOSURE

CROSS REFERENCE TO RELATED APPLICATIONS

This application is related to co-pending U.S. Design Patent Application No. 29/883,927, filed Feb. 5, 2023, now issued as U.S. Patent Design No. D1,053,017, issued Dec. 3, 2024, which is incorporated by reference herein.

STATEMENT REGARDING FEDERALLY SPONSORED RESEARCH

Not applicable.

BACKGROUND OF THE INVENTION

The present invention relates in general to interlock closures and storage containers sealed by such interlock closures, such as for food, and in particular flexible storage bags.

Storage containers for food are known in a variety of configurations, including flexible storage bags having resealable interlock closures. These storage bags have been well known in disposable versions as exemplified by Ziploc® brand storage bags, with two layers of film sealed about three sides, with the fourth side having an extruded interlocking rib structure. In recent years it has also been known to form flexible storage bags from silicone to extend their useful life as reusable storage bags. Many still use a similar interlocking rib structure even if not extruded.

SUMMARY OF THE INVENTION

An object of the present invention is to provide an interlock closure system having improved sealing.

Another object of the present invention is to provide an interlock closure system having improved ease of closure.

A further object of the present invention is to provide a reusable storage bag employing such an interlock closure system.

These and other objects are achieved by a storage bag with elastic interlock closure.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
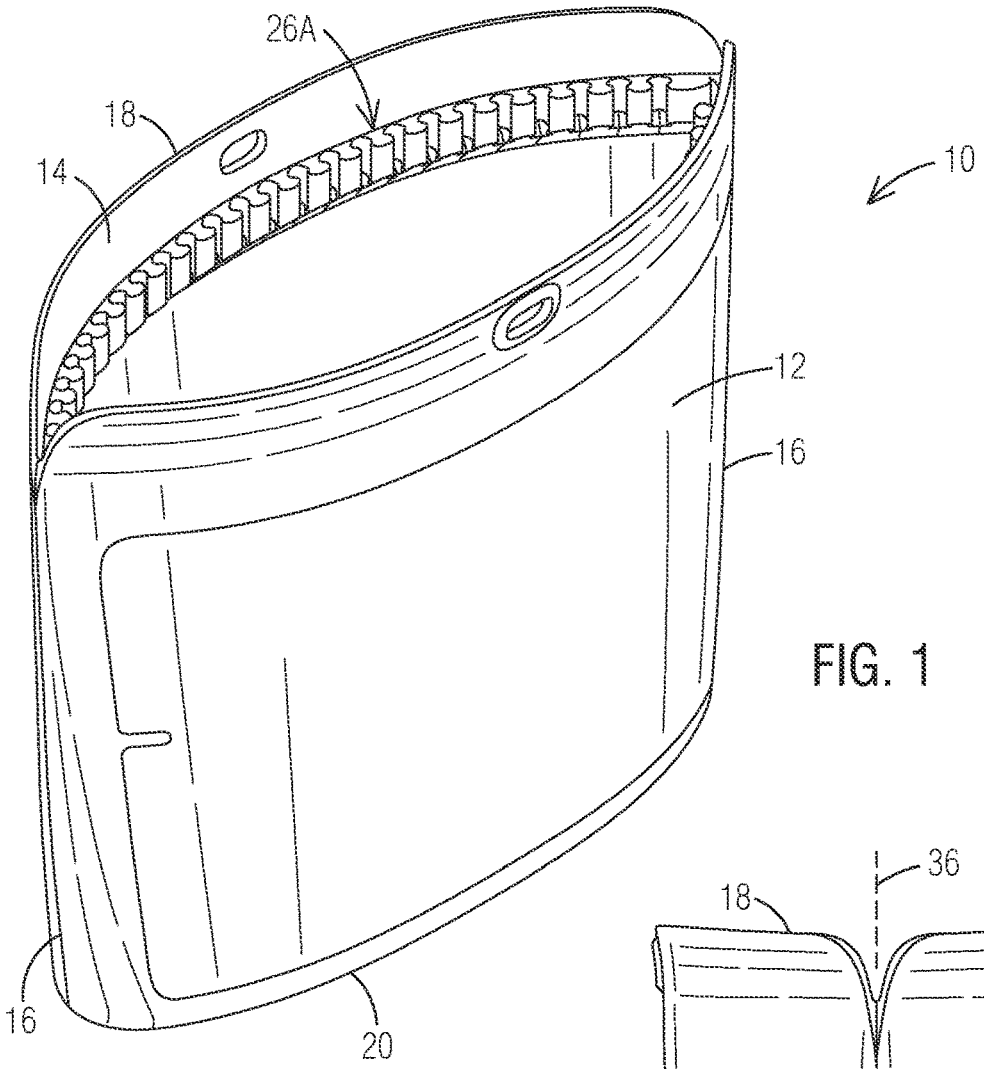
FIG. 1 is a top perspective view of a first embodiment of a storage bag with elastic interlock closure according to the present invention in the open configuration.

With reference to FIG. 1, a storage bag with elastic interlock closure according to the present invention is generally designated by reference numeral 10. The bag 10 is preferably a monolithic unit formed of an elastomeric material such as silicone. Bag 10 generally includes first and second side panels 12 and 14, respectively. The side panels 12 and 14 each include at least one peripheral edge. The side panels 12 and 14 may take a variety of shapes from circular (one peripheral edge), half-circular (two peripheral edges), triangular (three peripheral edges), square, or any variety of geometric or free-form shapes. In the embodiment shown, each side panel 12 and 14 has a generally trapezoidal shape and includes four peripheral edges, including two side edges 16, a top edge 18 and a bottom edge 20. In this embodiment, the side edges 16 are directly joined together. The bottom edges 20 are joined to a bottom panel 22 arranged to allow the bag 10 to stand upright unsupported on a countertop. While not shown, the bottom edges 20 could be directly joined to form a flat-style bag, as is known. Finally, the top edges 18 are not joined together, but are separate to form a mouth providing access to the interior of bag 10. While not shown, the top edges 18 could be partially joined (such as a portion at both sides, or a single portion at one side) with the remaining un-joined portion forming a smaller mouth, again as is known.

Figure 3:
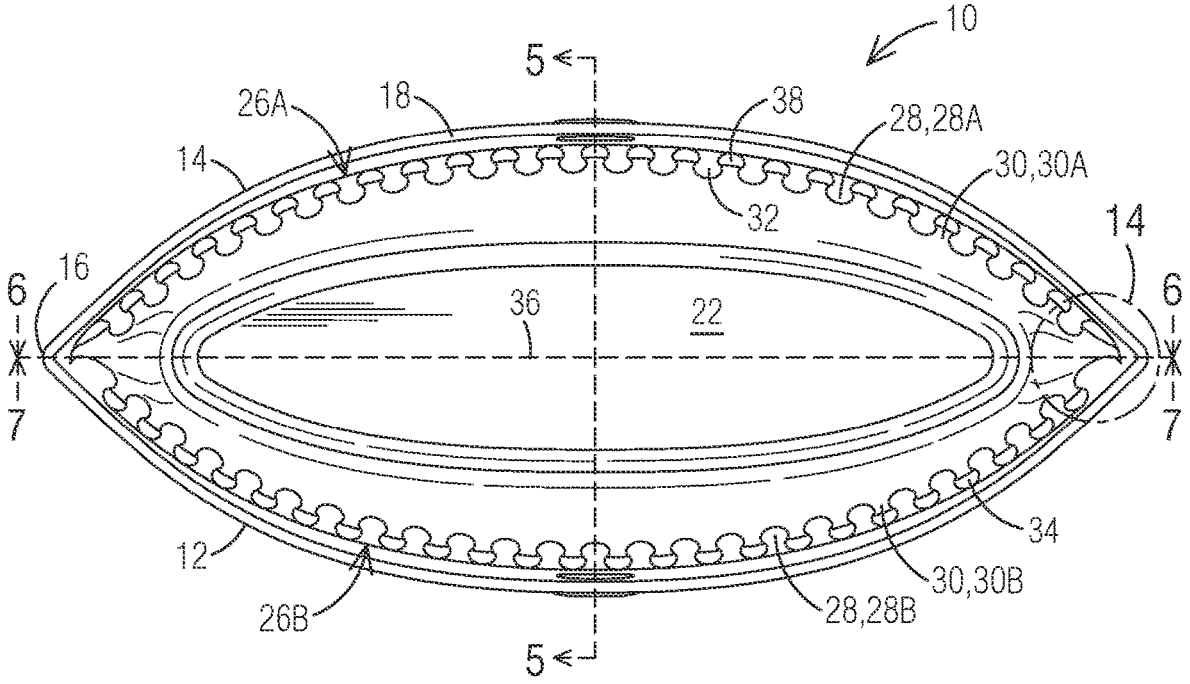
FIG. 3 is a top view thereof.

The above components and features of a storage bag are known, and the invention resides mainly within an interlock closure 24 provided on the bag 10. This interlock closure is formed of first and second strips 26A and 26B each formed of elastomeric material and which may be selectively secured together or separated. Each of the strips 26A and 26B is located on the interior face of a respective panel 12 and 14, opposed to each other such that the strips 26A and B overlay each other in the closed position of FIG. 4. Each of the strips 26A and B is comprised of a series of teeth 28 (each individually a tooth 28) spaced from each other by gaps 30. Each tooth 28 includes an enlarged head 32 at the free end thereof, such that the gaps 30 by definition conversely take a form with an enlarged segment 34. As is known in the art, the teeth 28 on one strip 26 are offset from the teeth on the opposing strip 26 such that the two sets of teeth 28 will each be received within the opposed set of gaps 30 of the opposing strip 26. This is illustrated with comparison of FIG. 3 with FIG. 4, where in FIG. 4 the teeth 28A are received within the gaps 30B, and teeth 28B are received in gaps 30A. The particular shape of the enlarged head 32 may vary considerably, but the preferred form is shown in the figures as being rounded on both the outer face as well as the undercuts on both sides, similar to forms well known in jigsaw puzzles.

Figure 2:
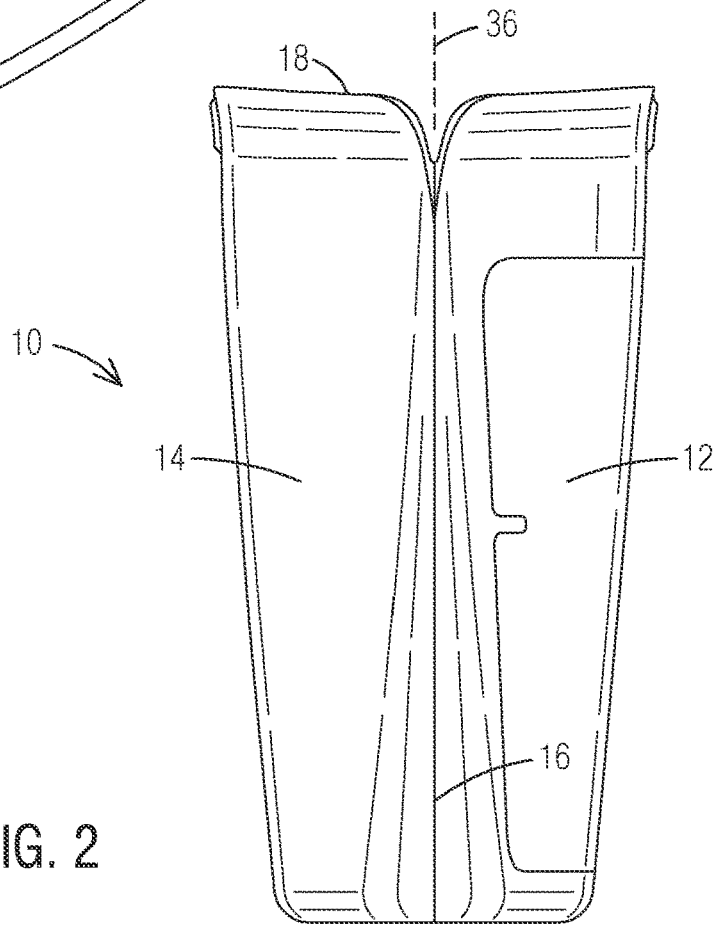
FIG. 2 is a side view thereof.
Figure 4:
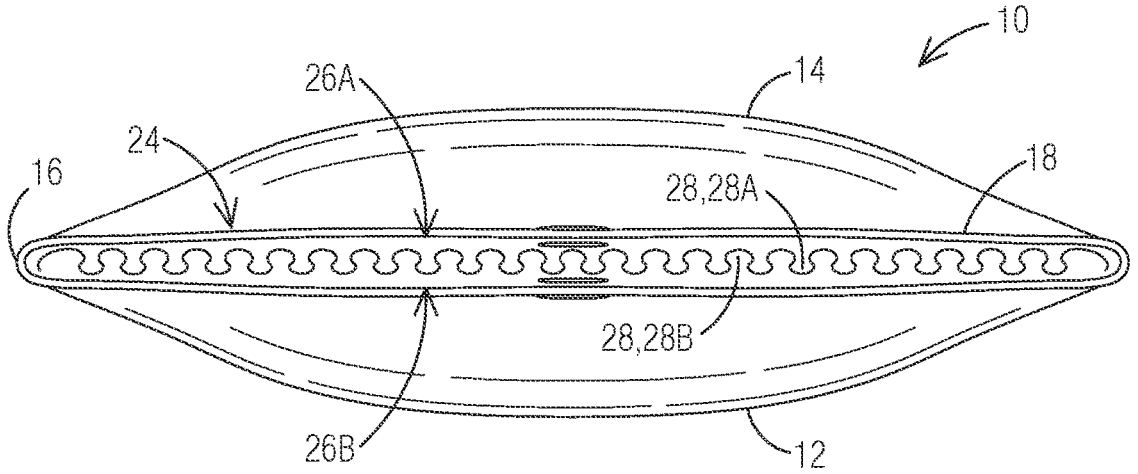
FIG. 4 is a top view in the closed position.
Figure 5:
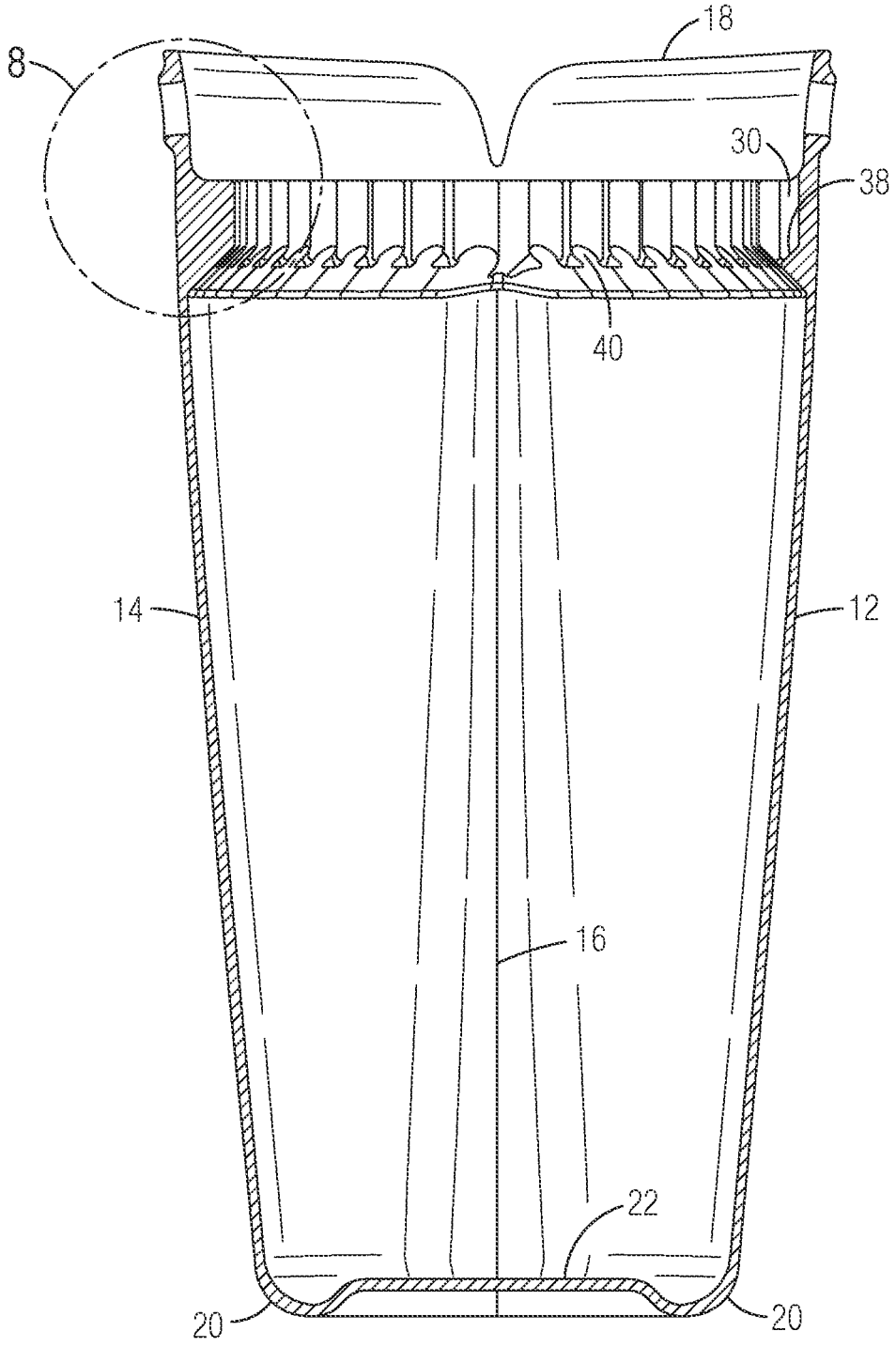
FIG. 5 is a side cross-sectional view along line 5-5 of FIG. 3.
Figure 6:
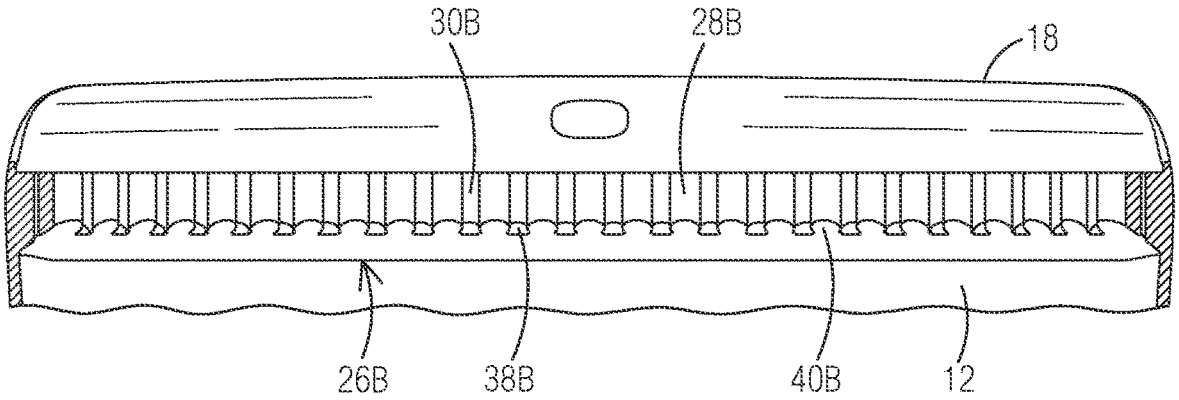
FIG. 6 is a side cross-sectional view along line 6-6 of FIG. 3.
Figure 7:
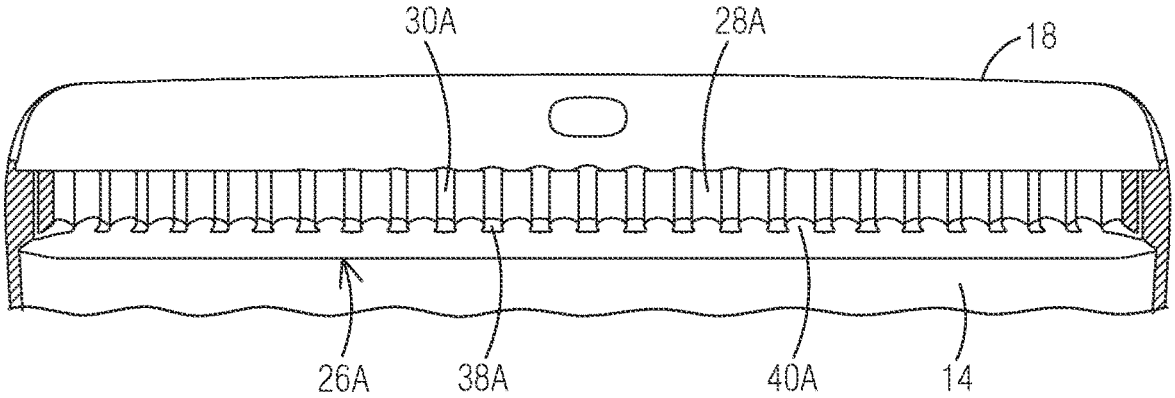
FIG. 7 is a side cross-sectional view along line 7-7 of FIG. 3.

This basic form of an interlock closure is also known in reusable storage bags, but the present invention provides improvements. As illustrated in FIG. 4, the strips 26A and B will come together and interlock along a plane 36 (extending into the page in FIGS. 2 and 3). When closed as in FIG. 4, it is seen that the enlarged head 32 will resist being removed from the segment 34 in a direction normal to plane 36 (from closed position of FIG. 4 toward the open position of FIG. 3). Further, the adjacent tooth 28B will block movement of tooth 28A laterally within plane 36 along the longitudinal axis of the strips 26A and B (as tooth 28A will block tooth 28B in the opposite lateral direction). However, a standard tooth 28 and gap 30 in the prior art will not resist relative vertical movement within the plane 36 (laterally of strips 26A and B within the plane 36). The prior art teeth 28 may freely slide out of engagement. For example, with reference to FIG. 4 in a standard prior art arrangement there is no impediment to strip 26A moving in a direction into the page, while the strip 26B moves in a direction out of the page. This relative movement would be seen to lead to the interlock closure 24 fully opening given sufficient vertical movement along the plane. But even partial vertical movement can reduce contact area of the teeth 28 and thus reduce the force required to open the closure 24 in the typical direction normal to plane 36. The present invention overcomes this problem.

Figure 8:
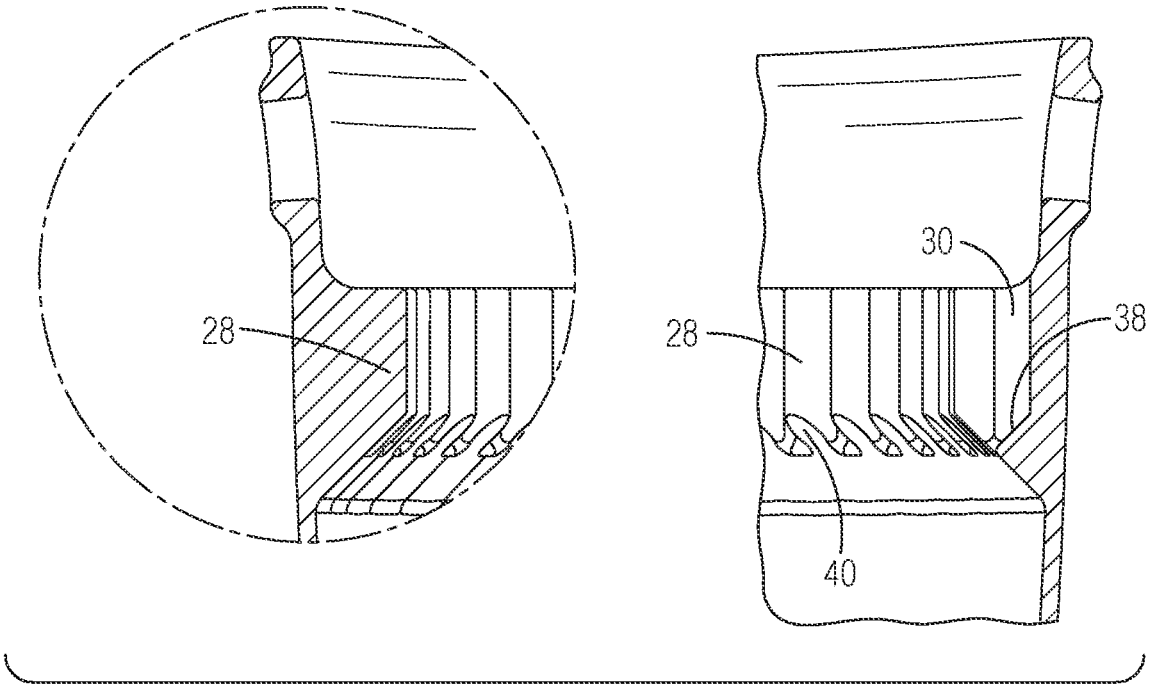
FIG. 8 is a detail side cross-sectional view from FIG. 5.

Specifically, in the present invention, a plurality of the gaps 30 (and preferably every gap 30) include a block ledge 38 extending outward from at least one of (and preferably each of) strips 26A and B, at a position closely interior to the anticipated position of the teeth 28 associated with those gaps 30 which include block ledges 38. In the embodiment shown, all gaps 30 are provided with block ledges 38, and these block ledges 38 are located immediately interior of the associated tooth 28 when in the closed position. The relative positions of a tooth 28, gap 30, and block ledge 38 may be seen in the open position of FIG. 8, and FIG. 9 further illustrates the closed position to demonstrate how this blocking ledge 38 provides the inventive feature.

Figure 9:
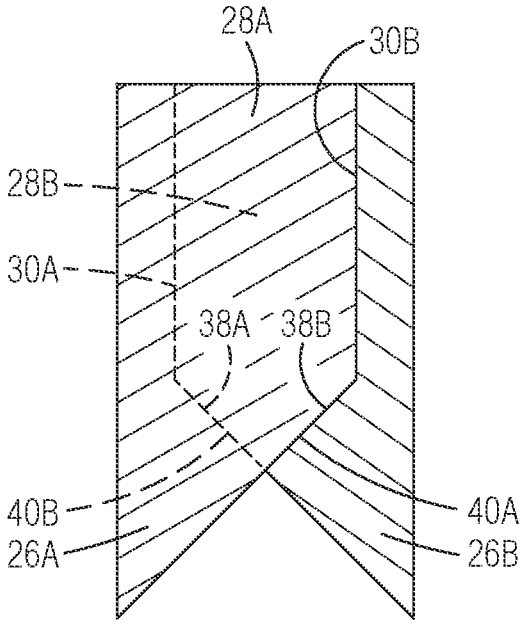
FIG. 9 is a side cross-sectional illustration of interlocked teeth from FIG. 8.

With reference to FIG. 9, it may be seen that the tooth 28A of strip 26A is received within the gap 30B of strip 26B. Further, as shown in phantom, behind the tooth 28A (that is, deeper in the direction into the page) there is a tooth 28B of strip 26B is received within a gap 30A of strip 26A. Each tooth 28A and B has an exterior face and an interior face. For a plurality of teeth 28, at least one of the faces will be designated a block face 40. In the embodiment of FIGS. 1-9, the interior face of every tooth 28A and B is designated a block face 40. Further, the block ledge 30B may be seen to lie immediately adjacent the block face of the tooth 28A. Similarly, in phantom it is seen that the block ledge 38A also lies immediately adjacent the block face of tooth 28B. These block ledges 38 formed on both strips 26A and B will, as noted, prevent relative movement of the strips 26A and B within the plane 36. In particular, it is easy to see that downward movement of strip 26A relative to strip 26B is prevented by block ledge 38B preventing relative downward movement of tooth 28A. With this in mind, it is also easy to see that downward movement of strip 26B relative to strip 26A is similarly prevented by block ledge 38A preventing relative downward movement of tooth 28B. By corollary, this also means that the teeth 28A and 28B similarly prevent relative upward movement of the abutting block ledges 38B and 38A, respectively, and therefore prevent relative upward movement of strip 26A relative to strip 26B and vice versa. As may be seen, the addition of block ledges 38 on each of the strips 26A and B prevents (or limits) vertical movement of the strips 26 relative to each other within the plane 36. This provides a vertical locking feature to the interlock closure 24.

In a further improvement on the standard tooth arrangement, it may be seen in the preferred embodiment, and as illustrated in FIG. 9, that the block face 40 of each tooth 28 is angled upward (outward toward the free end of teeth 28), and similarly the upper face of each block ledge 38 is angled downward (outward toward the free end of teeth 28) preferably but not necessarily at a complimentary angle. As may be envisioned, this use of angled surfaces creates a cam effect during closing. As the strips 26A and B move from the open position to the closed position, these angled surfaces 40 on the teeth 28 and the block ledges 38 will guide the teeth 28 A and B into the proper vertical positioning within their associated gaps 30B and A, respectively, and thus guide the strips 26A and B into proper vertical positioning in the closed position. This ensures the teeth 28 are properly and fully positioned within their associated gaps 30, thus creating the strongest interlock closure 24 possible, without the need for painstaking manual vertical alignment by the user during closing.

While the embodiment of FIGS. 1-9 is preferred, many variations are possible while still providing the vertical locking effect of the blocking ledges 38. A first variation is to simply invert the arrangement of FIGS. 1-9 such that the angled faces of the teeth 28 are on the upper face, and similarly locate the blocking ledges 38 at the upper edges of the gaps 30 (in other words, invert the entirety of the interlock closure 24 by 180 degrees). While providing the same mechanical effect, the outer visual effect would differ from that of FIG. 4.

Figure 10:
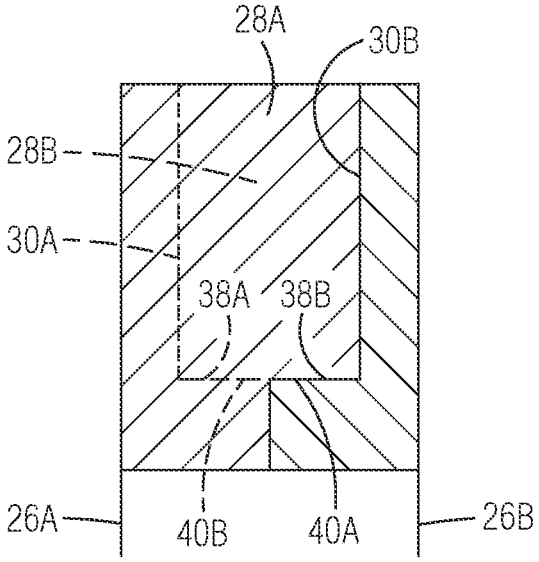
FIG. 10 is a side cross-sectional illustration of a second embodiment of interlocked teeth.

FIG. 10 illustrates another variation with the use of the blocking ledges 38 and block faces 40 in a simple perpendicular orientation without the angled faces. While no cam effect is provided during closing with this variation, it may be seen that the strips 26A and 26B will still be locked against relative vertical movement. In this embodiment of FIG. 10, the blocking ledges 38 have a combined length such that they abut one another in the closed position. This would provide a simple straight seam between the strips 26A and B, which could be desirable to reduce leakage or accumulation of the contents of the bag 10 at the interlock closure 24. The outer edges/free ends of block ledges 38 are shown as abutting at the center, but if desired some slight horizontal offset of block ledges 38 is possible in one direction or the other (left or right in FIG. 10), as is a variable offset (such as sinusoidal, sawtooth, etc.) along the length of the interlock closure 24. As with FIG. 9, yet a further variation is to invert the arrangement of FIG. 10 with the blocking ledges 38 at the upper end of the gaps 30. As before, this would provide the same mechanical effect while providing a different visual effect. In this case, the visual effect could be a very clean single parting line visible to the user, with the teeth 28 not visible in the closed position, or the sinusoidal, sawtooth or other patterns as noted above.

Figure 11:
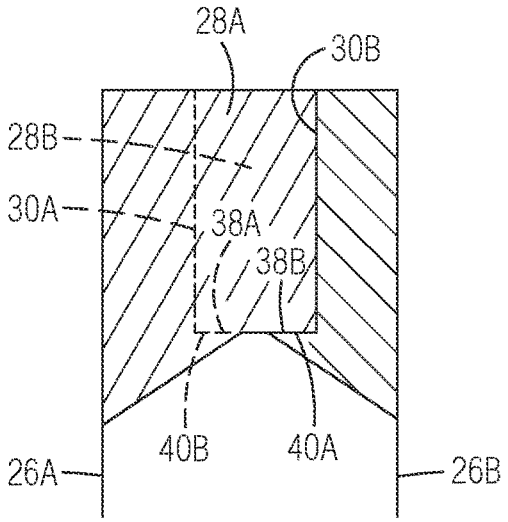
FIG. 11 is a side cross-sectional illustration of a third embodiment of interlocked teeth.

A further variation is shown in FIG. 11, with the main difference from FIG. 10 being that the outer edges/free ends of blocking ledges 38 are spaced from each other. This also illustrates that the blocking ledges 38 may have a different orientation than the remainder of the strips 26A or B. Here, the blocking ledges 38 are horizontal, while the remainder of the strips 26 are angled. Numerous variations are possible, and again, this embodiment of any variations could of course be inverted from the orientation shown.

Figure 12:
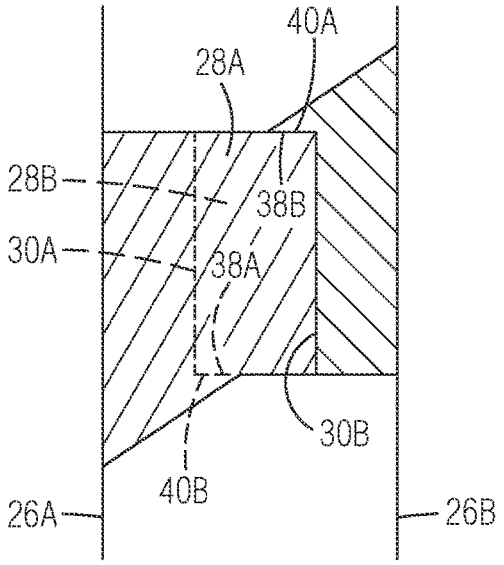
FIG. 12 is a side cross-sectional illustration of a fourth embodiment of interlocked teeth.

Yet a further variation is illustrated in FIG. 12. Here, it is illustrated that the block faces 40 may be on both the internal and outer faces of various ones of teeth 28A and B, and the block ledges 38 may be located both internally and externally of the teeth 28. In the arrangement shown, blocking ledges 38A and matching adjacent blocking faces 40B are located internally, while blocking ledges 38B and matching adjacent blocking faces 40A are located externally. Depending upon the geometry employed, this may result in the strips 26A and B being blocked from the relative vertical movement in only one direction, rather than both. While this is not preferred for the food storage bag disclosed herein, there may be other applications for a fastening system using strips 26A and B (such as straps for shoes, backpacks, etc.) where only one direction of movement need be blocked. And finally, this discussion started with a reference that at least one of the strips 26A and B include the blocking ledges 38. It is entirely possible for two blocking ledges 38 to be located on a strip 26A (one ledge interior, one ledge exterior), while mating strip 26B has no blocking ledges 38A.

This use of blocking ledges 38 and blocking faces 40 is one improvement of the present invention. As may be seen, the blocking ledges may increase the strength of the seal by preventing unintended disengagement of the teeth 28 from gaps 30. Additionally, if the block ledges and block faces are designed for abutment when interlocked, these additional surfaces in contact may create a better seal (such as being more water tight). Further, the geometry of the blocking ledges may be designed so as to act as camming surfaces to guide the teeth 28 properly into their respective gaps 30, as in the preferred embodiment. A second improvement is provided with the unique geometry at the lateral ends of the strips 26A and B. This is described below.

Figure 13:
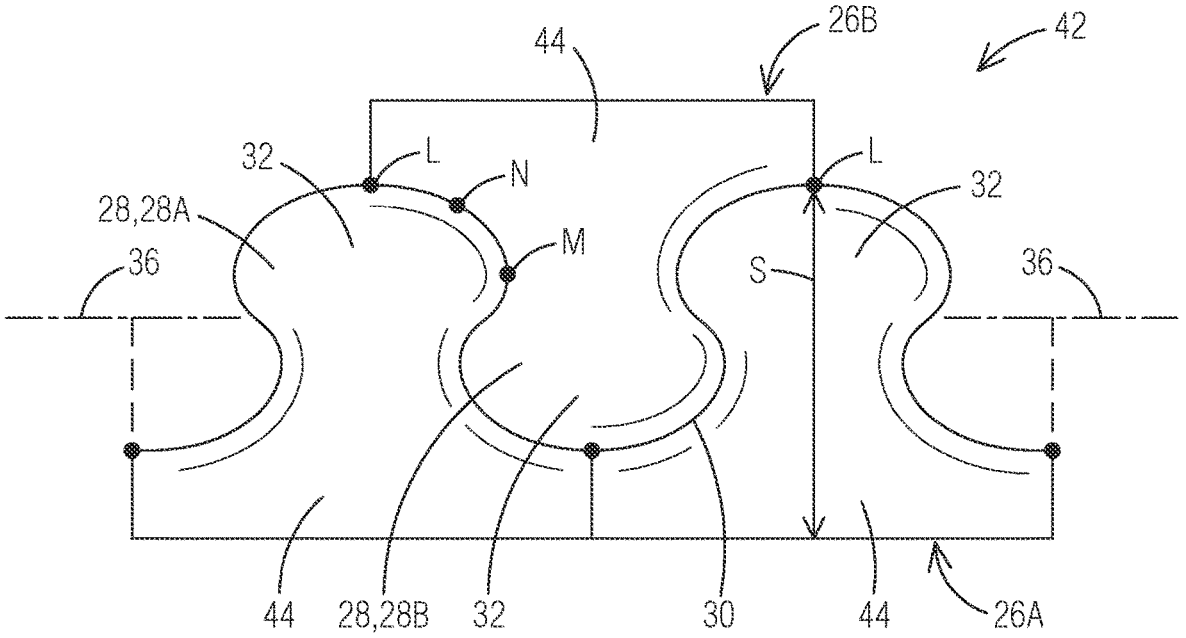
FIG. 13 is a top view illustration of interlocked teeth.

Before discussing the unique geometry of the invention, the prior art of standard teeth 28 and gaps 30 will be used for comparison. FIG. 13 illustrates a standard tooth and gap arrangement, but illustrated as broken into basic, repeated, elements for better understanding. These repeated elements will be referred to as interlock elements 42, and the interlock closure 24 is primarily composed of multiple repeated instances of interlock elements 42 arranged together along each of strips 26A and B. While the strips 26A and B could literally be formed of multiple identical elements 42 joined together, it is preferred that strips 26A and B be formed as monolithic units, with these elements 42 being merely illustrative of the repetitive geometric nature of the interlock closure 24.

Each of the interlock elements 42 includes a base 44 from which the tooth 28 extends (and which therefore also defines portions of the gaps 30). As shown, the tooth 28 is centrally located on the base 44 and the tooth 28 is symmetric about a central line. This is not strictly required. Any shape providing an enlarged head 32 shaped in a way to create gaps 30 which are an inverse mirror of shape of tooth 28 can be used. The important point to note here is that the outer face of the elements 42 (opposite the base 44) has a length S, and this length is equal for all elements 42.

Further, note that there may (and almost certainly will) be repetitive points of contact between the elements 42 on strip 26A and the elements 42 on strip 26B. For example, in the embodiment shown, the outmost points of teeth 28 on strip 26A will repeatedly coincide with the innermost points of the gaps 30 in strip 26B (and vice versa). Finally, also note that the outermost surfaces of strips 26A and 26B will nearly always both have tangent lines which are parallel at points at which they meet. For example, in the embodiment shown the outermost point L of tooth 28A will define a tangent line parallel to the interlock plane 36. Similarly, the innermost point L of the gap 30B receiving that tooth 28A will also have a tangent line parallel to interlock plane 36. This will typically extend to most if not all other adjacent surfaces on the strips 26A and B. For example in FIG. 13 the points M and N also have tangent lines which are parallel for both strips 26A and B. The tangent lines for point M would be perpendicular to the interlock plane 36, while the tangent lines for the point N are neither parallel nor perpendicular to the interlock plane 36.

Figure 14:
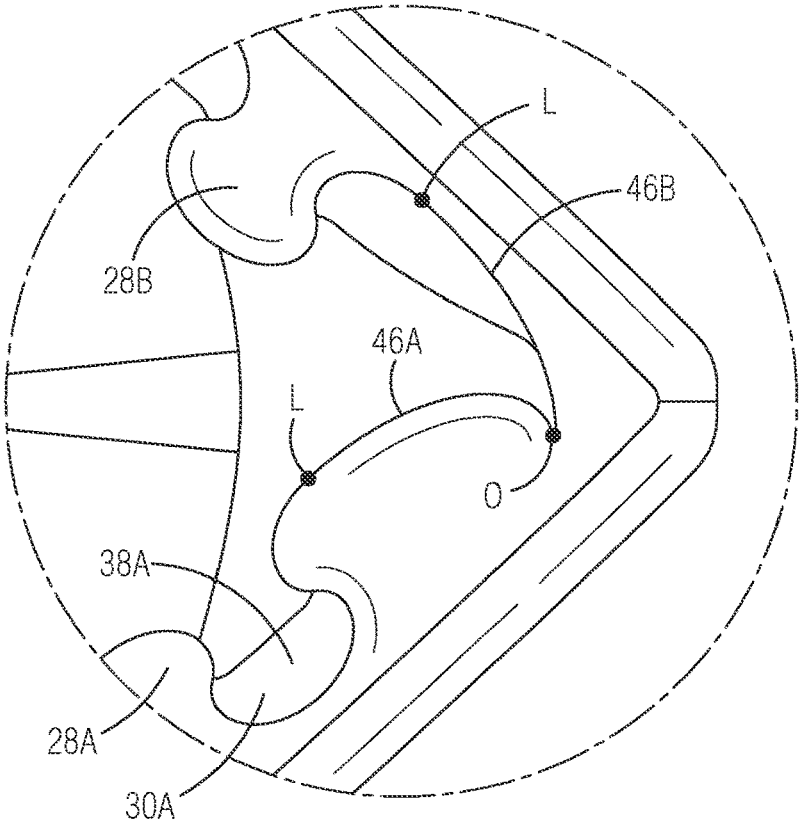
FIG. 14 is a detail top view from FIG. 3.

With this in mind, we return to the unique geometry at the lateral ends of the strips 26A and B, best illustrated with reference to FIGS. 14 and 15. If the strips 26A and B are to be connected together at one or both lateral ends, it is preferred that this connection be monolithic for increased strength and leak resistance. Given the difficulty of molding the teeth 28 (and in particular removing the teeth 28 from the mold given that the teeth 28 are by design shaped to maintain a secure engagement), it is not practical for the strips 26A and B to simply terminate. For example, if this termination were at the right-most point L in FIG. 13, it would be very difficult to remove the first tooth 28 (located on strip B and extending downward) from the mold. This desire for a monolithic connection requires that strips 26A and B include mating end segments 46A and B, respectively.

The mating end segments 46 could theoretically be linear, however in practice any compression stress applied along the interlock plane 36 would cause such linear end segments to bow apart to create a gap in the interlock closure 24. To prevent this, the present invention specifies that the linear end segments 46A and B include a curvature, such that at the common end point O of the end segments 46A and B a line T tangent to the end segments 46 forms an angle A with the interlock plane 36. In the embodiment shown, the end segments 46A and B begin from the final common point L. From the final point L the end segments extend at a tangent outward, and as such are initially parallel to the interlock plane 36. As may be seen, the end segments 46A and B have a common curvature toward their common lateral end point O, with the tangent line T at point O forming the angle A with interlock plane 36. This curvature will serve to minimize or completely prevent a gap in the interlock closure 24 upon compression as discussed above.

As may be envisioned, this curvature and angle A has an effect upon the leak-tight nature of the interlock seal 24. The angle A in particular (which is measured in the direction of curvature from the beginning point of the end segments 46) will affect the seal, and is preferably at least 15 degrees, preferably greater than 45 degrees, and most preferably greater than 90 degrees (as shown). It is also noted that a practical upper limit on the angle A is imposed by the need to de-mold the interlock closure 24. As such, an angle A great than 140 is less preferred.

Figure 15:
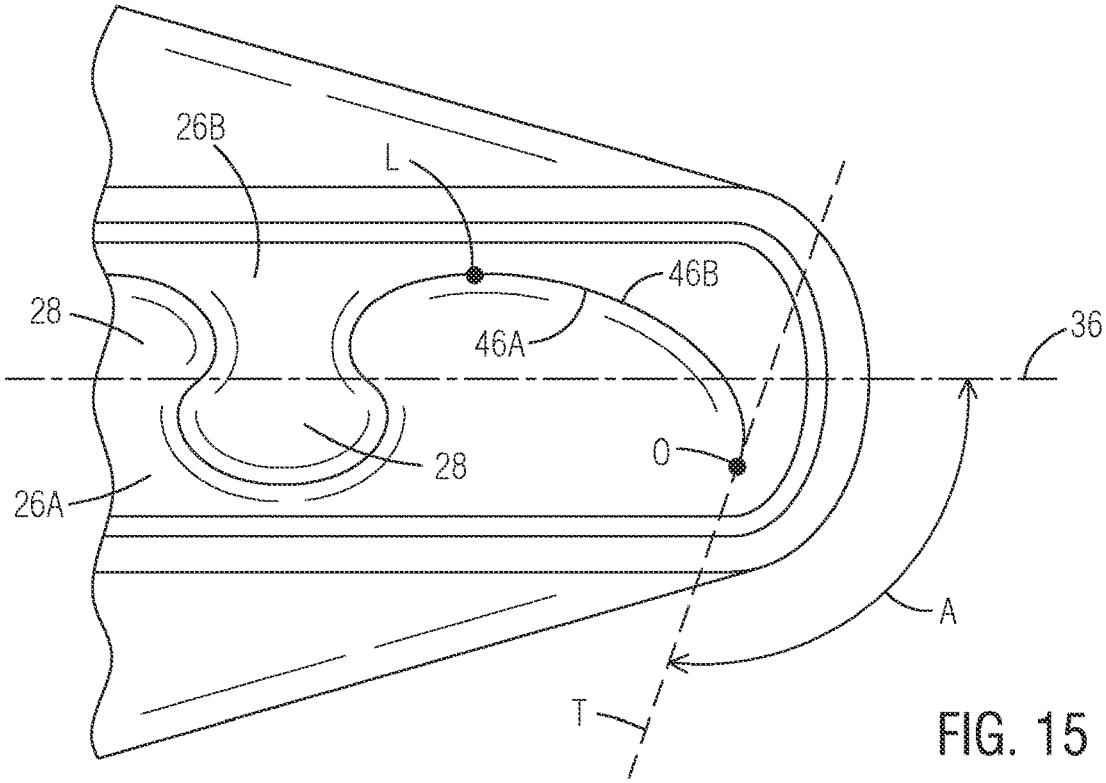
FIG. 15 is a detail top view from FIG. 4.
Figure 16:
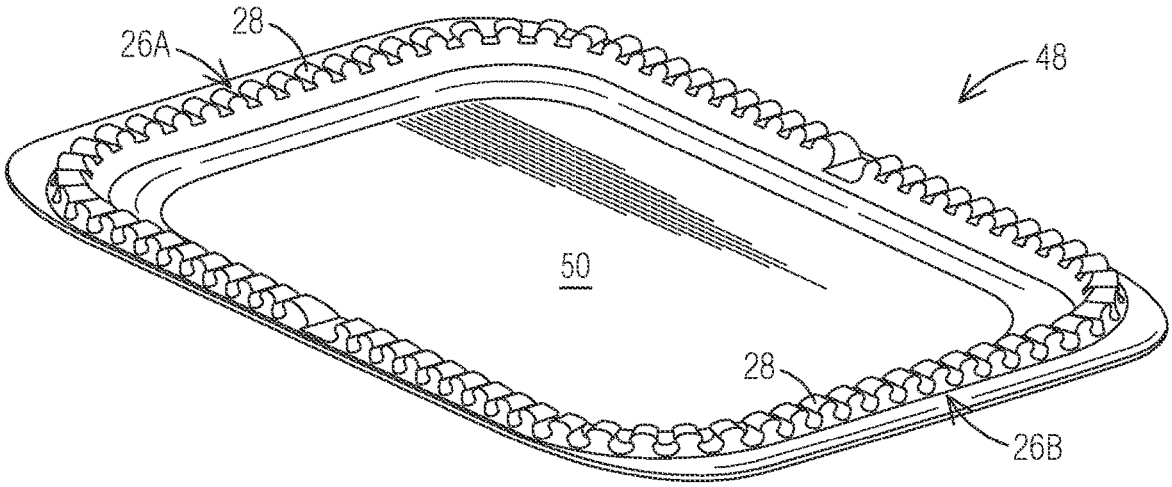
FIG. 16 is a top perspective view of a second embodiment of a storage bag with elastic interlock closure according to the present invention in the open configuration.
Figure 17:
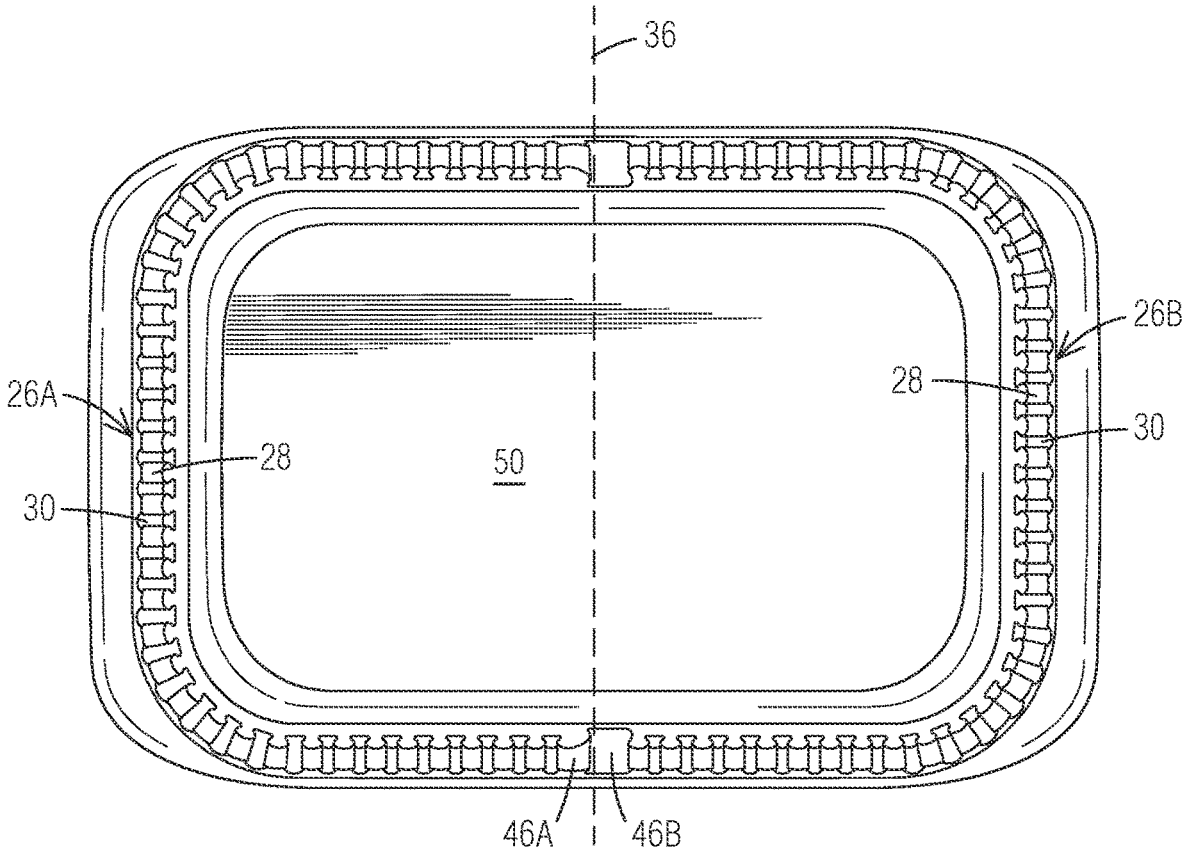
FIG. 17 is a top view thereof.

As best shown in FIG. 15, it is also preferred that the common end point O be located on the opposite side of interlock plane 36 than the beginning points of end segments 46. The interlock seal 24 and bag 10 will be molded in a partially open configuration similar to FIGS. 3 and 14. As may be seen from these figures, formation of the end segments 46 as in the preferred embodiment will permit de-molding of the end segments 46 with no more trouble than for typical teeth 28. However, during movement of the interlock closure 24 to the closed position of FIGS. 4 and 14 it may be seen that the end segment 46B will tend to wrap about the end segment 46A creating a tighter and more secure interlock closure 24. In this regard, note that similar to the surface on the interlock elements 42, the length of end segments 46A and 46B will be equal. By "equal" it is meant roughly equal: as may be envisioned, making end segment 46B very slightly smaller than end segment 46A will result in some necessary stretching of end segment 46B which would make the seal in this portion even stronger.

While the arrangement shown in preferred, there are variations possible while still creating the wrap-around feature. In particular, the end segments 46A and B could begin from points more similar to points M or N in FIG. 13, curve in the opposite direction from that shown in FIG. 15, and end above the interlock plane 36 in FIG. 15. Other variations for the end segments 46 are also possible.

Figure 18:
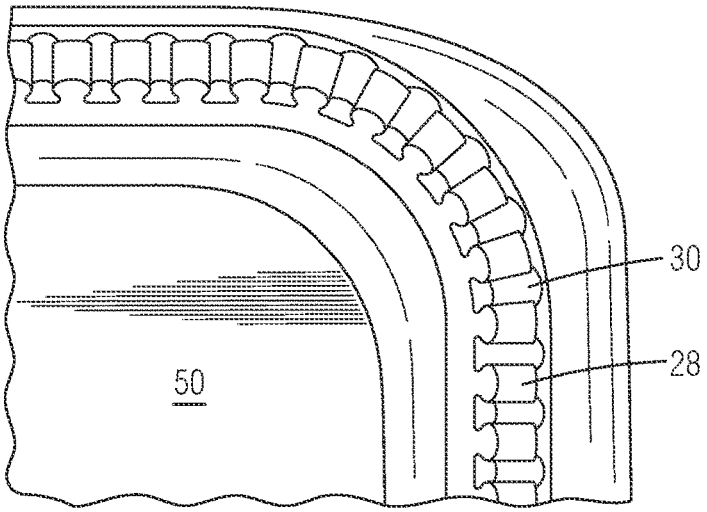
FIG. 18 is a detail top view.
Figure 19:
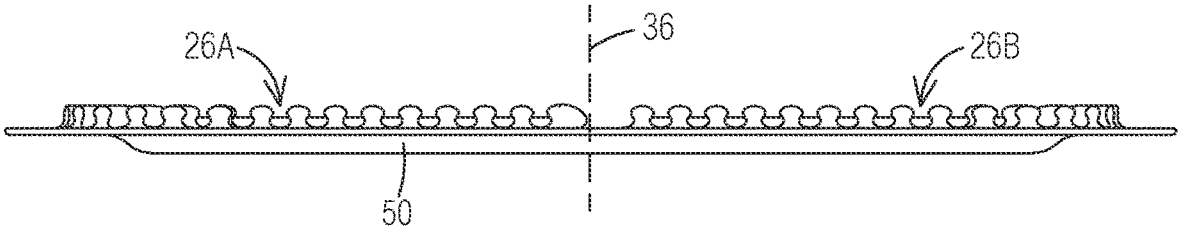
FIG. 19 is a side view.
Figure 20:
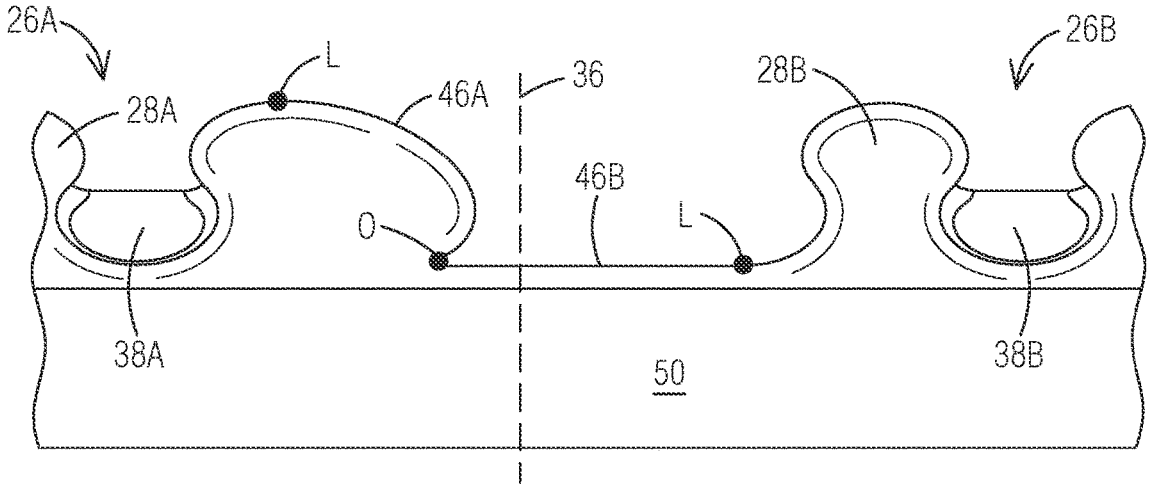
FIG. 20 is a detail side view of FIG. 19.

While the interlock closure system 24 has been disclosed for use in the mouth of the bag 10, it has myriad other uses. A different but related use is shown in FIGS. 16-20. Here a flat bag 48 is shown as being comprised of a main panel 50 bisected by an interlock plane 36, and with interlock strips 26A and B arranged along the periphery of main panel 50 on either side of the plane 36. The interlock strips 26A and B may be quite similar to those shown with bag 10 and include all the inventive features shown therein. This embodiment is merely intended to illustrate the varied applications of the inventive interlock closure system 24. As shown in FIG. 18, the teeth 28 and gaps 30 may be arranged as trapezoidal to allow for curvature of the strips 26A and B as needed. As may be envisioned, the main panel 50 may be folded in half to bring the mating interlock strips 26A and B into engagement. As before the end segments 46 may be used to ensure a good seal even at these ends.

The interlock closure system 24 of the present invention has a wide variety of uses as a general fastening system. Interlock strips 26A and B could be completely separate elements (not joined at the lateral ends as shown) of a fastening system, yet still employ the inventive block ledges and block faces to improve the integrity of the interlock. Similarly, the inclined block ledges and block faces could be employed to improve ease of alignment between the separate strips 26. These same features could also improve an interlock fastening system employing strips 26 joined only at one end, such as for use as a strap fastener for shoes, clothing, or other items. Whenever joined ends are used—either one or two (as shown)—the inventive curvature of the end segments could be used to improve seal.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. An interlock closure system comprising:

mating interlock strips A and B, each of strips A and B comprising a longitudinal axis and comprising a series of teeth spaced by gaps, the teeth being formed of an elastic material and comprising enlarged heads, and the gaps comprising enlarged segments to receive the heads, the teeth of strip A being offset laterally from the teeth of strip B such that the teeth of strip A will be received in the gaps of strip B and vice versa when the strips A and B are interlocked together along an interlock plane, wherein a plurality of the gaps of strip A and/or strip B each terminate in a direction transverse to the longitudinal axis with a blocking ledge extending toward the interlock plane and toward the respective other of the mating interlock strips A and B, and wherein each said blocking ledge is oriented at an angle toward the interlock plane to form a cam surface configured to guide respective teeth into an associated gap, and wherein the mating interlock strips are connected together monolithically at least at a first common lateral end point, and each comprises an end segment with a mating opposingly shaped common curvature comprising a final common point that has a tangent parallel to the interlock plane.

2. The interlock closure system of claim 1, wherein the common lateral end point is on a side of the interlock plane opposite that of the final common point.

3. The interlock closure system of claim 2, further comprising a second common lateral end point, wherein the first and second common lateral end points are at opposing ends of the mating interlock strips, wherein the mating interlock strips are connected together monolithically at the first and second common lateral end points.

4. The interlock closure system of claim 1, wherein the blocking ledges are dimensioned to extend to the interlock plane.

5. The interlock closure system of claim 1, wherein the blocking ledges are dimensioned to stop before reaching the interlock plane.

6. The interlock closure system of claim 1, wherein each of the gaps of strip A and/or strip B terminate with the blocking ledge.

7. The interlock closure system of claim 1, wherein the plurality of the gaps of strip A and/or strip B have a first set thereof that each terminate with the blocking ledge configured to engage a first face of a respective first tooth and a second set thereof that each terminate with the blocking ledge configured to engage a second face opposite the first face of a respective second tooth.

8. An interlock closure system comprising:

mating interlock strips A and B, each of strips A and B comprising a series of teeth spaced by gaps, the teeth being formed of an elastic material and comprising enlarged heads, and the gaps comprising enlarged segments to receive the heads, the teeth of strip A being offset laterally from the teeth of strip B such that the teeth of strip A will be received in the gaps of strip B and vice versa when the strips A and B are interlocked together, wherein the mating interlock strips A and B are connected together monolithically at least at a first common lateral end point, and wherein each of the mating interlock strips A and B terminate with a mating opposingly shaped common curvature defining respective end segments from a final common point that has a tangent parallel to an interlock plane to the first common lateral end point, and a tangent line of the first common lateral end point forms an angle relative to the interlock plane.

9. The interlock closure system of claim 8, wherein the common lateral end point is on a side of the interlock plane opposite that of the final common point.

10. The interlock closure system of claim 9, further comprising a second common lateral end point, wherein the first and second common lateral end points are at opposing ends of the mating interlock strips, wherein the mating interlock strips are connected together monolithically at the first and second common lateral end points.

11. An interlock closure system comprising:

mating interlock strips A and B, each of strips A and B having a longitudinal axis and comprising a series of teeth spaced by gaps along the longitudinal axis, the teeth being formed of an elastic material and comprising enlarged heads, and the gaps comprising enlarged segments to receive the heads, the teeth of strip A being offset laterally from the teeth of strip B such that the teeth of strip A will be received in the gaps of strip B and vice versa when the strips A and B are interlocked together along an interlock plane, wherein a plurality of the gaps of strip A and/or strip B each terminate in a direction transverse to the longitudinal axis with a blocking ledge extending toward the interlock plane and the respective other of the mating interlock strips A and B; and wherein the mating interlock strips A and B terminate with a mating opposingly shaped common curvature that begins at a final common point that has a tangent parallel to the interlock plane and ends at a common end point that connects interlock strip A to interlock strip B, and a tangent line of the common end point forms a first angle relative to the interlock plane.

12. The interlock closure system of claim 11, wherein each blocking ledge is oriented at an angle toward the interlock plane to form a cam surface.

13. The interlock closure system of claim 11, wherein the first angle is at least 15 degrees.

14. The interlock closure system of claim 11, wherein the first angle is greater than 45 degrees.

15. The interlock closure system of claim 11, wherein the first angle is in a range of 90 to 140 degrees.

16. The interlock closure system of claim 11, wherein the final common point and the common end point are on opposite sides of the interlock plane.

* * * * *